US007650997B2

(12) United States Patent
Nago

(10) Patent No.: US 7,650,997 B2
(45) Date of Patent: Jan. 26, 2010

(54) MERCHANDISE HOUSING CONTAINER

(75) Inventor: Akira Nago, Sakai (JP)

(73) Assignee: Shimano Inc., Osaka (JP)

( * ) Notice: Subject to any disclaimer, the term of this patent is extended or adjusted under 35 U.S.C. 154(b) by 707 days.

(21) Appl. No.: 11/147,293

(22) Filed: Jun. 8, 2005

(65) Prior Publication Data

US 2005/0284782 A1 Dec. 29, 2005

(30) Foreign Application Priority Data

Jun. 28, 2004 (JP) ..... 2004-189336

(51) Int. Cl.
*B65D 5/50* (2006.01)
*B65D 77/04* (2006.01)

(52) U.S. Cl. ..... 206/775; 206/315.11; 206/784; 206/756

(58) Field of Classification Search ..... 206/736, 206/315.11, 756, 781, 591, 765, 769, 770, 206/771, 772, 774, 775, 784, 592, 558; 229/101, 229/140, 87.06, 162.7, 162.1, 120.01, 103.2
See application file for complete search history.

(56) References Cited

U.S. PATENT DOCUMENTS

| | | | | |
|---|---|---|---|---|
| 3,228,518 | A * | 1/1966 | Coby | 206/562 |
| 3,722,781 | A * | 3/1973 | Page et al. | 206/563 |
| 4,146,128 | A * | 3/1979 | Hogg et al. | 206/776 |
| 4,319,681 | A | 3/1982 | Gestetner | |
| 4,511,079 | A * | 4/1985 | Lopez | 229/101 |
| 5,385,238 | A * | 1/1995 | Lancaster et al. | 206/594 |
| 5,522,504 | A * | 6/1996 | Levi | 206/424 |
| 5,996,804 | A | 12/1999 | Kuhn et al. | |
| 6,527,123 | B1 * | 3/2003 | Ausaf | 206/549 |
| 6,612,482 | B2 * | 9/2003 | Ross | 229/103.2 |
| 6,691,869 | B2 * | 2/2004 | Knaack et al. | 206/446 |
| 6,736,261 | B1 | 5/2004 | Thomas et al. | |
| 6,758,340 | B1 * | 7/2004 | Feibelman | 206/775 |
| 7,097,042 | B2 * | 8/2006 | Hsu | 206/751 |
| 2006/0086630 | A1 * | 4/2006 | Cheong et al. | 206/312 |

FOREIGN PATENT DOCUMENTS

| | | |
|---|---|---|
| DE | 20017067 U | 12/2000 |
| EP | 0761550 A | 3/1997 |
| FR | 1083400 A | 1/1955 |
| JP | H10-45171 | 2/1998 |

* cited by examiner

*Primary Examiner*—Mickey Yu
*Assistant Examiner*—Steven A. Reynolds
(74) *Attorney, Agent, or Firm*—Shinjyu Global IP

(57) ABSTRACT

A merchandise housing container for visibly accommodating merchandise includes an inner box having a first base portion, first, second, third and fourth sidewall portions, a lid portion and first and second securing portions. The first base portion, the first, second, third and fourth sidewall portions, the lid portion and the first and second securing portions are integrally formed of a single transparent plastic sheet. The first and second securing portions are provided so as to elastically contact two sides of the merchandise for restricting movement of the merchandise.

20 Claims, 9 Drawing Sheets

MERCHANDISE HOUSING CONTAINER

CROSS-REFERENCE TO RELATED APPLICATIONS

This application claims priority to Japanese Patent Application No. 2004-189336. The entire disclosure of Japanese Patent Application No. 2004-189336 is hereby incorporated herein by reference.

BACKGROUND OF THE INVENTION

1. Field of the Invention

This invention generally relates to merchandise housing containers. More specifically, the present invention relates to box-shaped merchandise housing containers for accommodating merchandise.

2. Background Information

In recent years, merchandise of many kinds is accommodated in box-shaped merchandise housing containers when displayed in stores. Conventional merchandise housing containers are box-shaped and are formed of a transparent sheet made of urethane resin or the like, for example. A merchandise housing container of this kind has a lid, provided separately from the container, that is placed on an upper face or a bottom face of the box so that the lid is able to be opened and closed to accommodate merchandise in the interior of the box. The transparent synthetic resin sheet of the merchandise housing container allows the accommodated merchandise to be visible from the exterior. Thus, consumers can view the merchandise without opening containers displayed in stores. By presenting the merchandise to consumers in this way, the display has a greater effect.

The accommodated merchandise in such a merchandise housing container is prone to being repositioned or damaged from an outside impact caused during shipment or storage. In view of this problem, it is conceivable to pack a cushioning material made of foamed polystyrene or paper around the merchandise in order to alleviate the outside impact. Packing such a cushioning material, however, may cause reduced visibility of the merchandise from the exterior even though the merchandise housing container is formed of a transparent synthetic resin sheet.

To resolve this problem, a known merchandise housing container has a configuration in which elastic transparent sheets are bonded to openings in the box and the lid so as to clasp and elastically support the merchandise between two transparent sheets. (See, for example, Japanese Publication No. H10-45171.) In this merchandise housing container, two transparent sheets clasp and elastically support the merchandise. Thus any impact from the outside is alleviated to protect the merchandise. At the same time, visibility of merchandise is ensured by the transparent sheets. However, the merchandise housing container requires four transparent sheets. That is, the merchandise housing container requires two transparent sheets for clasping the merchandise therebetween, one sheet for the box and one for the lid, which is separate from the box. Even if the box and the lid are formed integrally of a single transparent sheet, at least three transparent sheets are required. This necessitates extra manufacturing steps for processing transparent sheets and consequently, increases manufacturing cost.

One of the two transparent sheets used for clamping the merchandise is placed inside the opening of the lid and the other is placed inside the opening of the box. Accordingly, the merchandise is clasped between the two transparent sheets only when the lid is fixed on the box. When the lid is not firmly fixed to the box, the two transparent sheets are hindered from supporting the merchandise. Therefore, reliable protection of the merchandise is impeded.

In view of the above, it will be apparent to those skilled in the art from this disclosure that there exists a need for an improved merchandise housing container that visibly accommodates merchandise and keeps the manufacturing cost low while reliably protecting the merchandise.

This invention addresses this need in the art as well as other needs, which will become apparent to those skilled in the art from this disclosure.

SUMMARY OF THE INVENTION

One object of the present invention is to provide a merchandise housing container that reliably protects and visibly accommodates the merchandise. Another object of the present invention is to provide a merchandise housing container that is easier to manufacture and thereby lower manufacture costs.

A merchandise housing container according to a first aspect of the present invention is a merchandise housing container including a base portion, a sidewall and a securing device. The sidewall surrounds the base portion and defines a first housing space for interiorly accommodating merchandise. The securing device is formed by folding a portion of the sidewall inwardly from an upward edge of the sidewall to elastically contact a side of the merchandise that is accommodated in the first housing space for restricting movement of the merchandise. The base portion, the sidewall and the securing device are formed integrally by folding a single sheet of transparent plastic.

Because the base portion, the sidewall portions, and the securing device are formed of a transparent plastic sheet, the merchandise inside is visible from the exterior. In addition, the merchandise housing container has a securing device formed by inwardly folding at least a portion of the upward edge of the sidewall to elastically contact a side of the merchandise. Restricting movement of the merchandise with the securing device restricts movement of the merchandise irrespective of the position of the lid. The securing device is more reliable than the conventional devices in which movement of merchandise is restricted by a transparent sheet in the box and another transparent sheet in the lid. Moreover, the base portion, the sidewall portion, and the securing device are integrally formed of a single folded transparent sheet, thereby making it unnecessary to use three or more transparent sheets. Thus, the number of manufacturing steps for processing transparent sheets is reduced. Consequently, with such a securing device, the merchandise inside the merchandise housing container is reliably protected while the manufacturing cost is kept low.

A merchandise housing container according to a second aspect of the present invention is the merchandise housing container according to the first aspect, further including a seat part having an obverse face on which the merchandise is carried, and forming between itself and the base portion a second housing space, for accommodating an accessory to the merchandise. In this case, even when, for example, the merchandise is much smaller than the merchandise housing container, the securing device is easily brought into contact with a side of the merchandise. By carrying the merchandise on the obverse face of the seat part, restriction of movement of the merchandise is facilitated. Moreover, by forming the seat part from an opaque material, it is possible to hide accessories to the merchandise that are contained in the second housing space.

A merchandise housing container according to a third aspect of the present invention is the merchandise housing container according to the second aspect of the present invention, further including a cut-out for clasping the merchandise formed by cutting out a portion of the obverse face of the seat part. In this case, movement of the merchandise is restricted more reliably.

A merchandise housing container according to a fourth aspect of the present invention is the merchandise housing container according to the second or third aspect of the present invention, wherein the seat part is formed integrally by folding a single sheet of paper. In this case, manufacturing cost can be kept low by forming the seat part by folding a single sheet of paper.

A merchandise housing container according to a fifth aspect of the present invention is the merchandise housing container according to any of the first through fourth aspects of the present invention, further including an openable and closable lid portion provided on an edge of the sidewall where the securing device is not formed for closing over the first housing space. In this case, the interiorly accommodated merchandise can be protected by closing the first housing space with the lid portion.

A merchandise housing container according to a sixth aspect of the present invention is the merchandise housing container according to fifth aspect of the present invention wherein the lid portion is formed unitarily with the base portion, the sidewall and the securing device by folding a single sheet made of transparent plastic. In this case, since the lid portion, the base portion, the sidewall and the securing device are formed integrally by folding a single transparent sheet, the number of manufacturing steps can be reduced, thereby keeping the manufacturing cost low.

A merchandise housing container according to a seventh aspect of the present invention is the merchandise housing container according to any of the first through sixth aspects of the present invention, further including a cover part having an opening through which the merchandise is exteriorly exposable and is fitted over the outside of the base portion and the sidewall. In this case, the merchandise inside is visible through the opening while the base portion and the sidewall are protected by the cover part.

A merchandise housing container according to an eighth aspect of the present invention is the merchandise housing container according to the seventh aspect of the present invention, wherein the cover part is formed integrally by folding a single sheet of paper. In this case, by forming the cover part by folding a sheet of paper, which is generally inexpensive, manufacturing cost is kept low.

A merchandise housing container according to a ninth aspect of the present invention is the merchandise housing container according to any of the first through eighth aspects of the present invention, wherein the base portion is formed so as to be substantially rectangular. The sidewall portion is folded from the base portion at substantially right angles and formed in four portions so that each is substantially rectangular. The securing device is formed in two portions so as to fold inwardly from the upward edge of the sidewall in two opposing locations among the four portions of the sidewall. In this case, movement of the merchandise can be easily restricted by clasping the merchandise with two opposing portions formed by folding inwardly from the upward edge of the sidewall in two opposing locations.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 7:
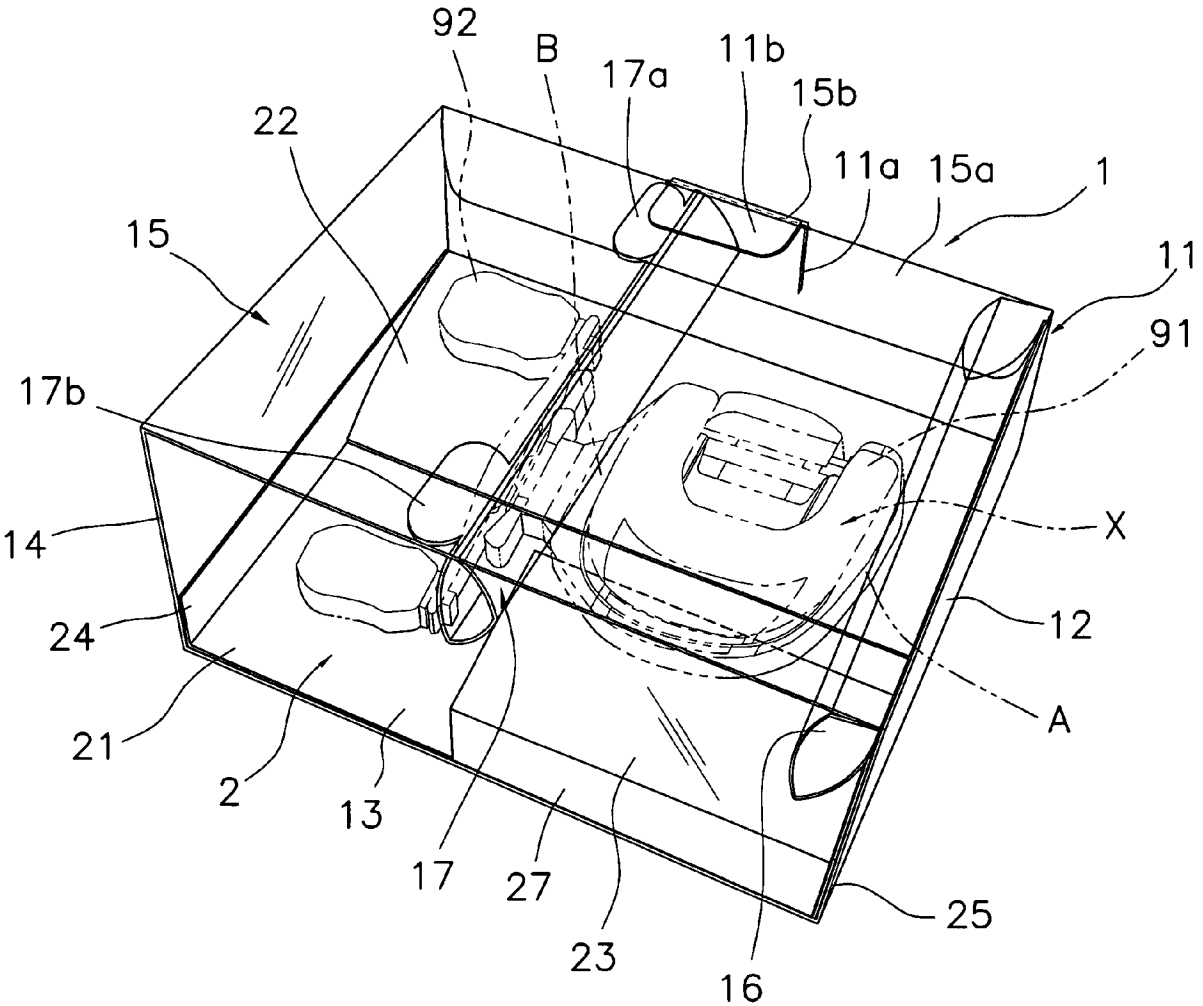
FIG. 7 is a perspective view of the assembled seat part illustrated in FIG. 5 seated in the assembled inner box illustrated in FIG. 4 in accordance with one embodiment of the present invention.
Figure 8:
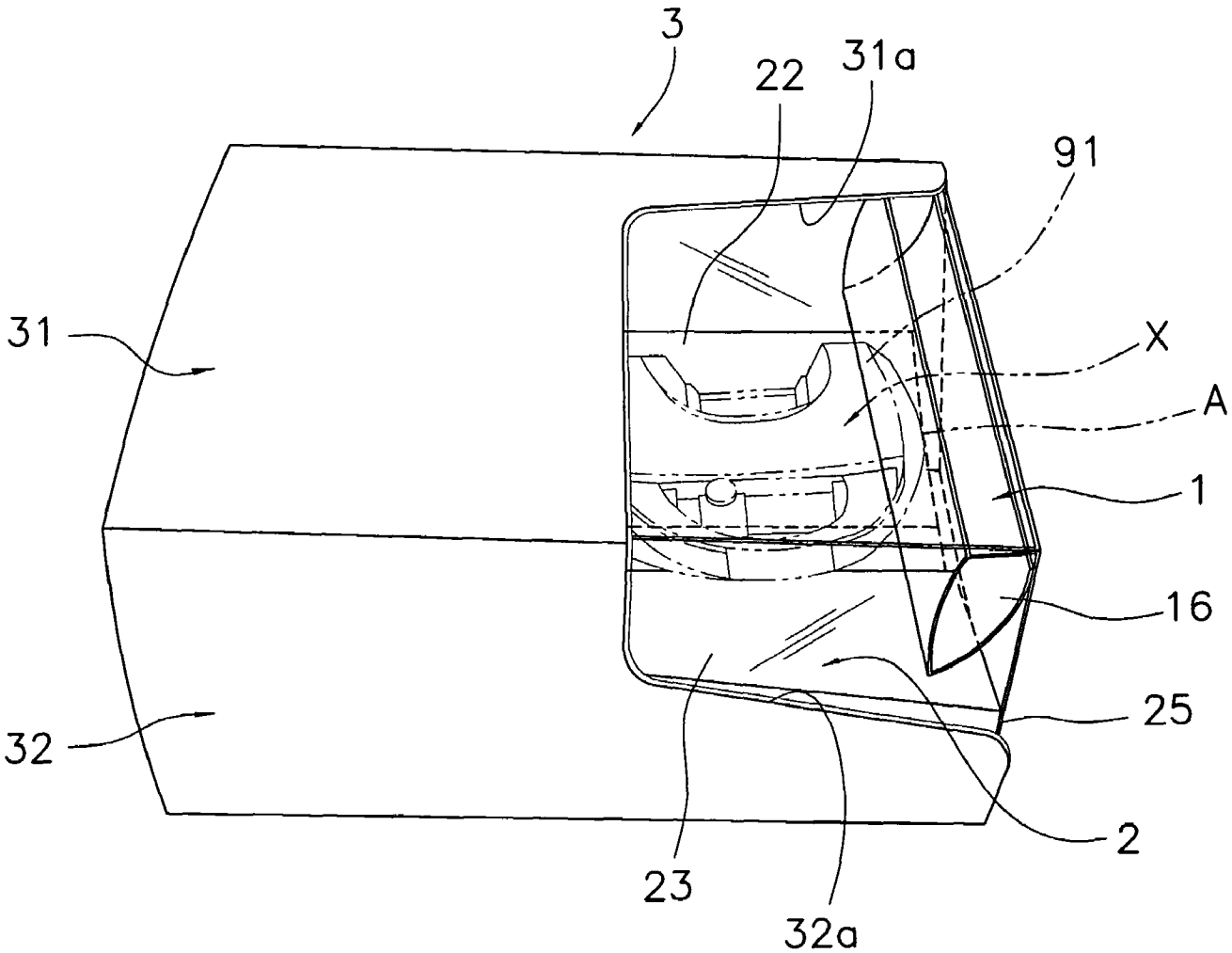
FIG. 8 is a perspective view of the assembled cover part illustrated in FIG. 6 fitted over the assembled seat seated in the assembled inner box illustrated in FIG. 7 in accordance with one embodiment of the present invention.
Figure 9:
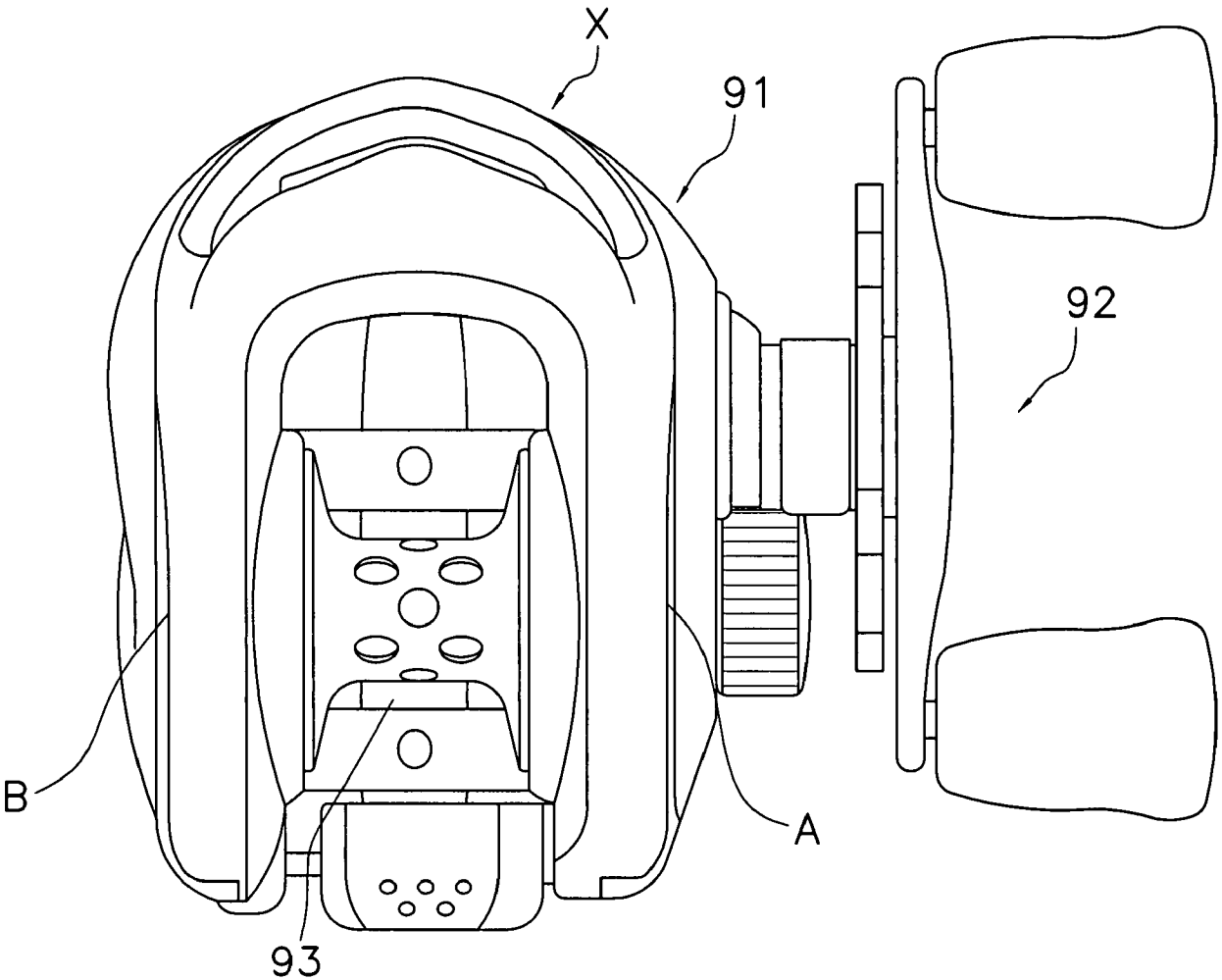
FIG. 9 is an elevational view of a dual-bearing reel to be accommodated in the merchandise housing container in accordance with one embodiment of the present invention.

A merchandise housing container that adopts one embodiment of the present invention is, as illustrated in FIGS. 7 and 8, for accommodating merchandise X in the interior thereof and displaying it in a store. The merchandise X may be a dual-bearing reel, for example. The dual-bearing reel is a conventional reel that is well known in the art. Since the dual-bearing reel is well known in the art, the structure will not be discussed or illustrated in detail herein. The dual-bearing reel includes, as illustrated in FIG. 9, a reel body 91, a spool-cranking handle 92 arranged on one side of the reel body 91 and a rod-mounting leg part 93. The rod-mounting leg part 93 extends front to rear and is made of metal. The rod-mounting leg part 93 is fixed on a lower part of the reel body 91 for mounting the dual-bearing reel onto a fishing rod.

Referring to FIGS. 1-6, the merchandise housing container is furnished with an inner box 1, a seat part 2 and a cover part 3. The merchandise X is accommodated in the interior of the inner box 1. The seat part 2 is attached to the inside of the inner box 1. The cover part 3 is attached to the outside of the inner box 1. The inner box 1 is formed integrally by folding a single transparent plastic sheet. Each of the seat part 2 and the cover part 3 is formed integrally by folding a single opaque paper sheet. Each of the inner box 1, the seat part 2 and the cover part 3 has obverse faces. The obverse faces are the entire surfaces of the inner box 1, the seat part 2 and the cover part 3 shown in FIGS. 1-3.

Figure 1:
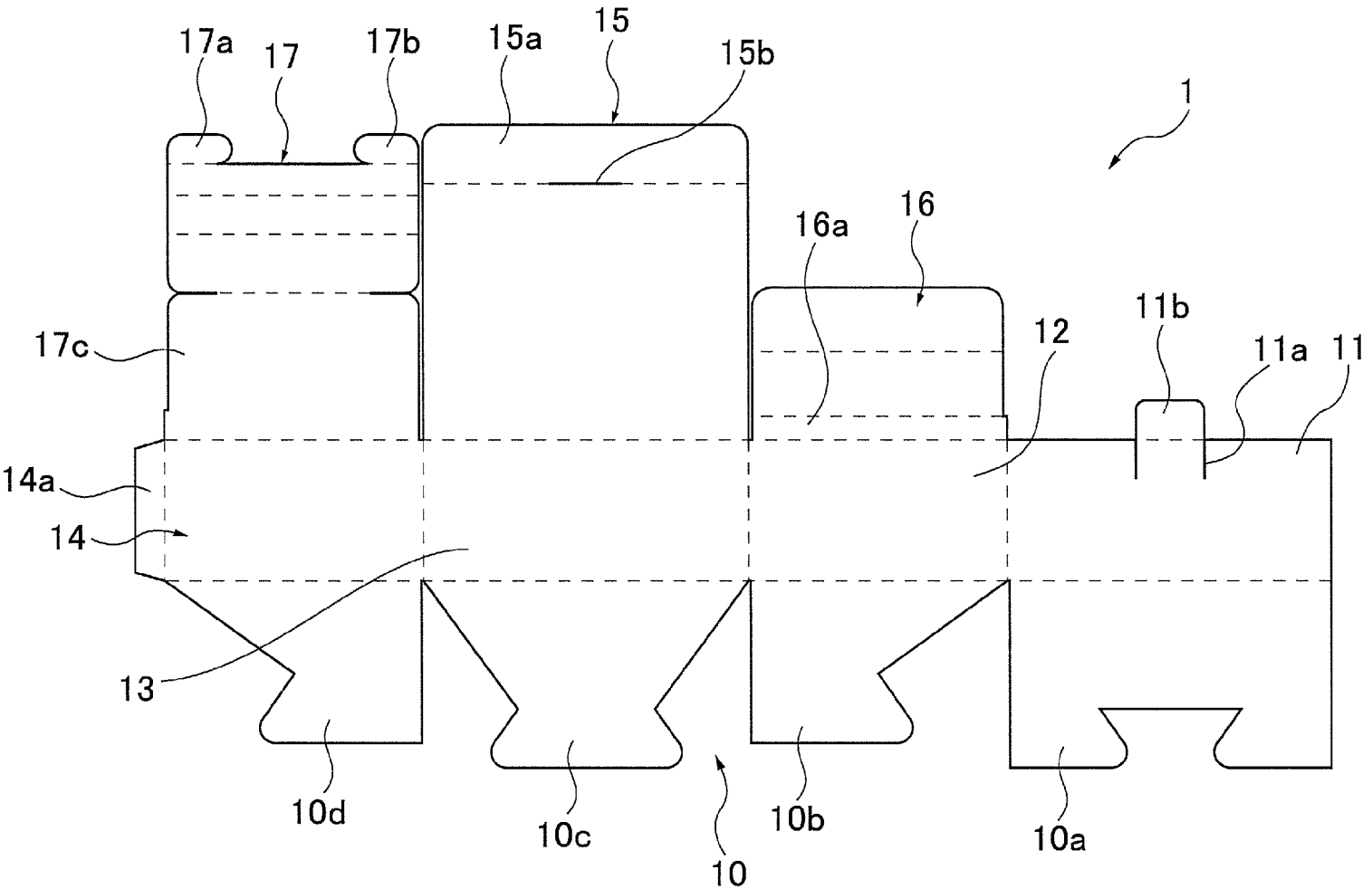
FIG. 1 is an elevational view of an obverse face of an inner box of a merchandise housing container in an unfolded condition in accordance with one embodiment of the present invention.
Figure 4:
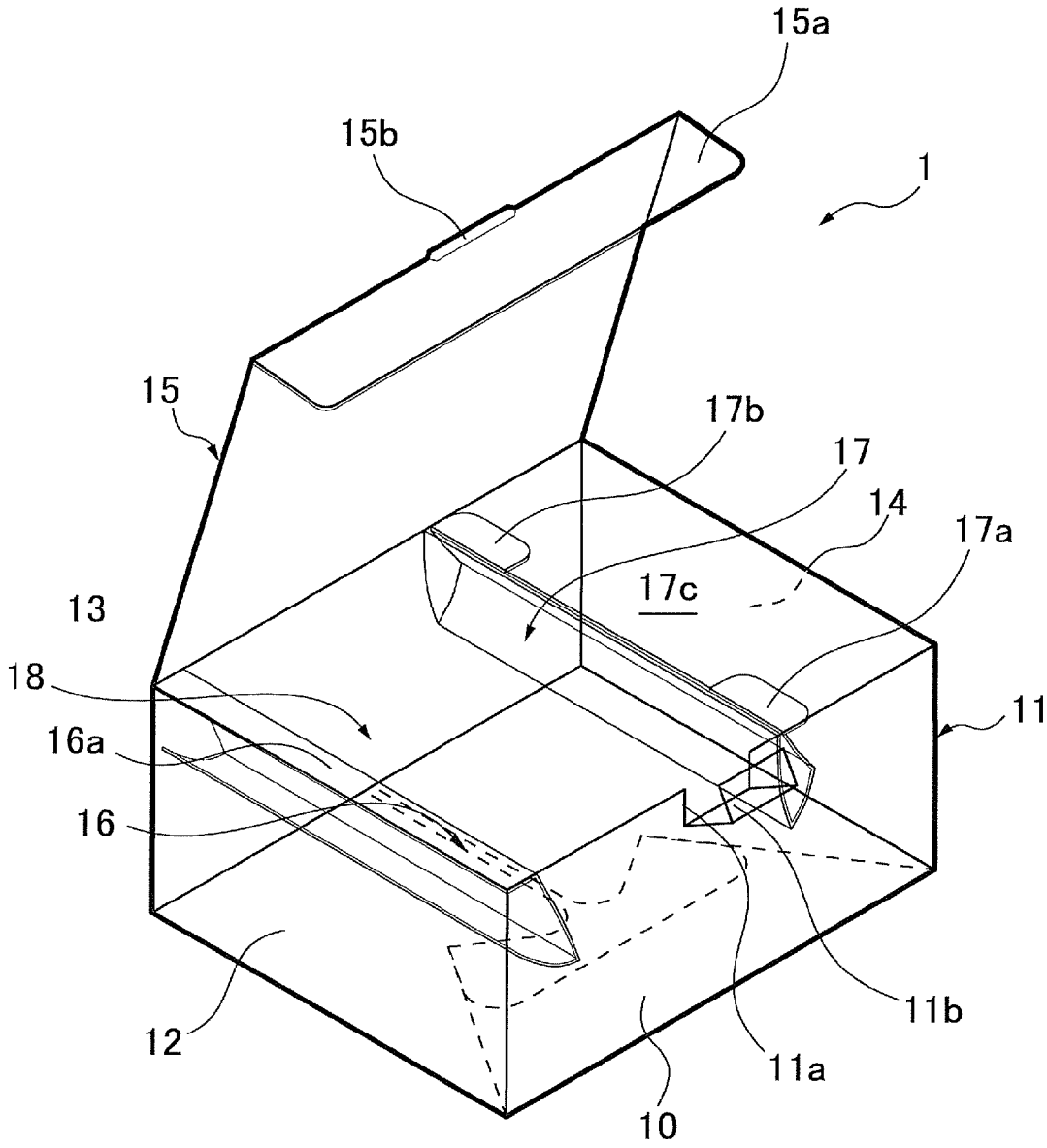
FIG. 4 is a perspective view of the inner box of the merchandise housing container illustrated in FIG. 1 in an assembled condition in accordance with one embodiment of the present invention.

As illustrated in FIG. 1, the inner box 1 includes a first base portion 10, a first sidewall portion 11, a second sidewall portion 12, a third sidewall portion 13, a fourth sidewall portion 14, a primary lid portion 15, a first securing portion 16 and a second securing portion 17. The inner box 1, as illustrated in FIGS. 1 and 4, is assembled by folding a single, transparent, synthetic, resin sheet, such as polypropylene (PP) or polyethylene (PE), into a box shape. The first base portion 10, the first sidewall portion 11, the second sidewall portion 12, the third sidewall portion 13, the fourth sidewall portion 14, the lid portion 15, the first securing portion 16 and the second securing portion 17 are integrally formed of a single transparent resin sheet.

The first base portion 10 is in a substantially rectangular shape. The first, second, third and fourth sidewall portions 11, 12, 13 and 14 are formed by folding four sides of the first base portion 10 at substantially right angles. The lid portion 15 is formed to be able to be opened and closed by folding the resin sheet inwardly from an upward edge of the third sidewall portion 13. The first securing portion 16 is formed by inwardly folding an upward edge of the second sidewall portion 12. Similarly, the second securing portion 17 is formed by inwardly folding an upward edge of the fourth sidewall portion 14. The inner box 1 is a rectangular parallelepiped in which merchandise X is accommodated. The first securing portion 16 and the second securing portion 17, as illustrated in FIG. 7, elastically contact both sides of the merchandise X for restricting movement of the merchandise X.

The first base portion 10 includes, as illustrated in FIG. 1, a first base part 10*a*, a second base part 10*b*, a third base part 10*c* and a fourth base part 10*d*. Each of the first, second, third and fourth base parts 10*a*, 10*b*, 10*c* and 10*d* is formed on the respective side of each of the first sidewall portion 11, the second sidewall portion 12, the third sidewall portion 13 and the fourth sidewall portion 14. The forward ends of the first base part 10*a*, the second base part 10*b*, the third base part 10*c* and the fourth base part 10*d* form interlocking flanges and interlocking catches that interlock with one another when folded over. By interlocking the interlocking flanges and the interlocking catches together, the first base portion 10 is formed in a substantially rectangular outer shape. The first, second, third and fourth sidewall portions 11, 12, 13 and 14 form a sidewall that surrounds the base portion and defines a first housing space 18 for interiorly accommodating merchandise.

Referring to FIG. 1, each of the first sidewall portion 11, the second sidewall portion 12, the third sidewall portion 13, and the fourth sidewall portion 14, have a generally rectangular shape and are formed consecutively in one direction so as to be folded one by one at right angles. An end of the first sidewall portion 11 that is opposite the first base portion 10 has a first interlocking slit 11*a* and a first interlocking tab 11*b*. The first interlocking slit 11*a* is for interlocking the lid portion 15 after the lid portion 15 has been closed. The first interlocking tab 11*b* protrudes from a center of an edge portion of the first sidewall portion 11. The first interlocking tab 11*b* is for interlocking the closed lid portion 15 so that the lid portion 15 does not open. The first interlocking slit 11*a* is cut into a portion of the first sidewall portion 11 from the base end of the first interlocking tab 11*b*. The first interlocking tab 11*b* is formed so that its upward end protrudes from the first sidewall portion 11. The first interlocking tab 11*b* is configured to fold at the edge of the first sidewall portion 11 at a substantially right angle. The first sidewall portion 11, the second sidewall portion 12, the third sidewall portion 13, and the fourth sidewall portion 14 are assembled, as illustrated in FIG. 4, such that the first sidewall portion 11 opposes the third sidewall portion 13 while the second sidewall portion 12 opposes the fourth sidewall portion 14. The first base portion 10, the first, second, third and fourth sidewall portions 11, 12, 13 and 14 and the lid portion 15 form a hollow rectangular parallelepiped.

The fourth sidewall 14 includes a first joining tab 14*a*. On one end of the fourth sidewall portion 14, a first joining tab 14*a* is also consecutively formed. The first joining tab 14*a* is able to be bonded to one end of the first sidewall portion 11 by a double-sided adhesive tape or the like.

The lid portion 15, as illustrated in FIGS. 1 and 4, is configured to fold at an edge of the third sidewall portion 13, which is opposite the third base part 10*c*, such that the lid portion 15 is openable and closable. The lid portion 15 has a second interlocking tab 15*a* and a second interlocking slit 15*b*. The second interlocking tab 15*a* further projects such that the upward end can be folded along a fold line and interlocked into the first interlocking slit 11*a* of the first sidewall portion 11. The second interlocking slit 15*b* is formed by cutting a center portion of the fold line near the upward end of the lid portion 15. First, the second interlocking tab 15*a* of the lid portion 15 is interlocked into the first interlocking slit 11*a* of the first sidewall portion 11. When the lid portion 15 is closed, the first interlocking tab 11*b* of the first sidewall portion 11 is interlocked into the second interlocking slit 15*b* of the lid portion 15. Thus, the lid portion 15 is not open inadvertently.

Referring to FIGS. 1, 4 and 7, the first securing portion 16 is formed by folding the resin sheet inwardly a plurality of times from an auxiliary lid portion 16*a* interconnected with the second sidewall portion 12. Specifically, the first securing portion 16 is formed by folding the resin sheet two times from an edge section of the auxiliary lid portion 16*a* interconnected with the second sidewall portion 12 so as to have an interior space. The second securing portion 17 is formed by folding the resin sheet inwardly a plurality of times from an auxiliary lid portion 17*c* interconnected with the fourth sidewall portion 14. Specifically, the second securing portion 17 is formed by folding the resin sheet three times inwardly from an edge section of the auxiliary lid portion 17*c* interconnected with the fourth sidewall portion 14 so as to have an interior space. The auxiliary lid portion 16*a* and 17*c* covers, for example, up to but no more than 50% of the first base portion 10. The second securing portion 17 has a second joining tab 17*a* and a third joining tab 17*b* that are folded outwardly and bonded to an inner surface of the auxiliary lid portion 17*c* with a double-sided adhesive tape or the like.

Referring to FIG. 7, the first securing portion 16 and the second securing portion 17 are folded so as to have interior spaces. Therefore, when the merchandise X is clasped between the first securing portion 16 and the second securing portion 17, as illustrated in FIG. 7, an elastic force that presses either side of the merchandise X is produced. In particular, when the merchandise X is a dual-bearing reel, the first securing portion 16 comes into elastic contact with a side A of the reel body 91. The second securing portion 17 comes into elastic contact with a side B of the reel body 91 to which the handle 92 is fitted. Thus, movement of the dual-bearing reel is restricted.

It will be apparent to one of skill in the art from this disclosure that it is also possible to provide only one securing portion or a plurality of securing portions rather than the first securing portion 16 and the second securing portion 17. In addition, the shapes of the first securing portion 16 and the second securing portion 17 and the number of times they are folded can be selected as appropriate.

The seat part 2 is on the first base portion 10 of the inner box 1, as illustrated in FIG. 7. The merchandise X is carried on the obverse faces of the seat part 2. The seat part 2 forms a second housing space 19 between one of the obverse faces and the first base portion 10. The second housing space 19 is configured and arranged to accommodate an accessory to the merchandise X. The seat part 2 is formed integrally, for example, by folding a single sheet of opaque paper such as a corrugated cardboard.

It will be apparent to one of skill in the art from this disclosure that the seat part 2 and the cover part 3 are not limited to a single opaque sheet of paper such as cardboard paper. For example, an opaque synthetic resin can be used.

The name of the merchandise X, instructions, and the like are printed on at least one of the obverse faces of the seat part 2. Since the inner box 1 is formed of a transparent, folded sheet, the print on the at least one obverse face of the seat part 2, which is placed inside the inner box 1, is visible from the outside.

Figure 2:
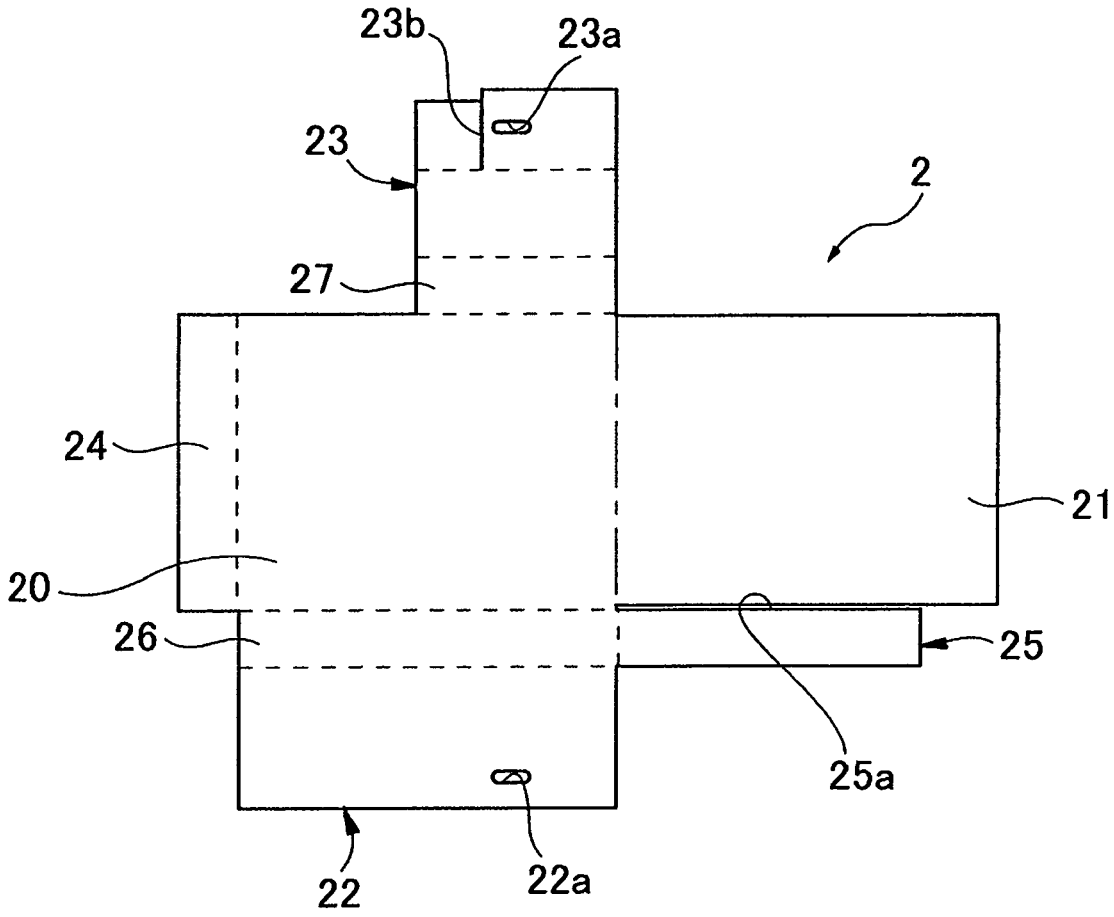
FIG. 2 is an elevational view of an obverse face of a seat part of the merchandise housing container in an unfolded condition in accordance with one embodiment of the present invention.
Figure 5:
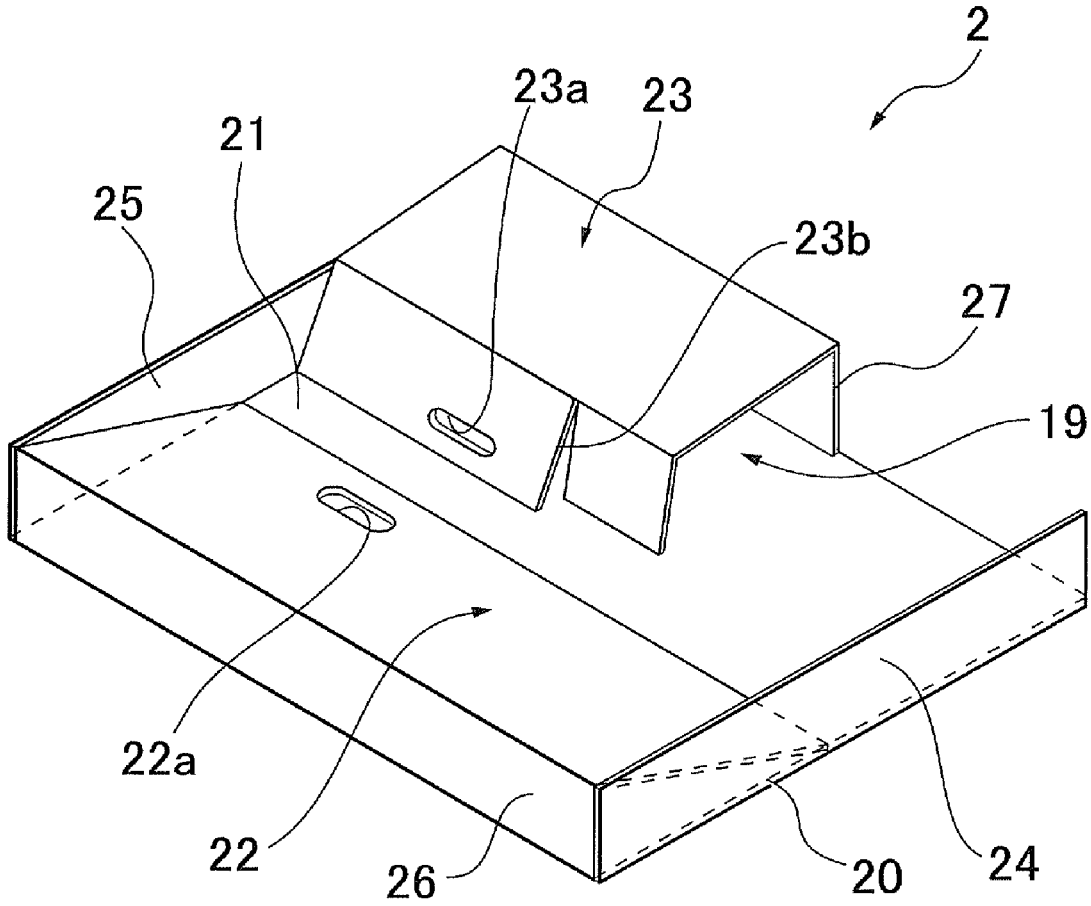
FIG. 5 is a perspective view of the seat part of the merchandise housing container illustrated in FIG. 2 in an assembled condition in accordance with one embodiment of the present invention.

As illustrated in FIGS. 2 and 5, the seat part 2 is formed in a substantially rectangular shape that is slightly smaller than the first base portion 10 of the inner box 1. The seat part 2 includes a second base portion 20, a third base portion 21, a first retaining portion 22 and a second retaining portion 23. The second base portion 20 rests on the first base portion 10. The third base portion 21 is formed in the same shape as the second base portion 20 and is folded so as to rest on a reverse face (non-printed face) of the second base portion 20. The first and second retaining portions 22 and 23 are provided on upward and downward ends of the second base portion 20 so as to be foldable a plurality of times for retaining the merchandise X on their obverse faces. The seat part 2 further includes a fifth sidewall portion 24, a sixth sidewall portion 25, a seventh sidewall portion 26, and an eighth sidewall portion 27 that are consecutively formed around the second base portion 20. The fifth, sixth, seventh and eighth sidewall portions 24, 25, 26 and 27 surround the circumference of the third base portion 21 when folded at substantially right angles. The fifth sidewall portion 24 is formed on an edge of the second base portion 20 that is opposite the third base portion 21. The seventh sidewall portion 26 is formed between the first retaining portion 22 and the second base portion 20. The eighth sidewall portion 27 is formed between the second retaining portion 23 and the second base portion 20. The sixth sidewall portion 25 is provided with a first slit 25*a* between the sixth sidewall portion 25 and the third base portion 21. The sixth sidewall portion 25 is formed integrally with the seventh sidewall portion 26. The first slit 25*a* allows the sixth sidewall portion 25 to be folded to a side edge of the third base portion 21.

The first retaining portion 22 is folded so as to be at an incline with respect to the third base portion 21. The first retaining portion 22 is folded over the second base portion 20, as shown in FIGS. 5 and 7. The downward end of the first retaining portion 22 contacts the obverse face of the third base portion 21. The first retaining portion 22 is also provided with a first cut-out 22*a*. The first cut-out 22*a* is formed by cutting out a substantially elliptical portion of the first retaining portion 22. The first cut-out 22*a* retains a portion of the merchandise X and thereby restricts movement of the merchandise X. When the merchandise X is a dual-bearing reel, movement of the reel is restricted by inserting one end of the rod mounting leg part 93 of the reel into the first cut-out 22*a*.

The second retaining portion 23 is arranged such that its upward end opposes the downward end of the first retaining portion 22 when folded. The second retaining portion 23 is folded a plurality of times so as to be inclined with respect to the third base portion 21. The second retaining portion 23 is folded over the second base portion 20. The second retaining portion 23 is spaced apart from the fifth sidewall portion 24 and thus, has a width less than that of the first retaining portion 22. Accordingly, as seen in FIG. 5, a gap is created across the third base portion 21 between the eighth sidewall portion 27 and the fifth sidewall portion 24. The gap creates a height difference. When the merchandise X is a dual-bearing reel, the handle 92 of the reel can be placed in the height difference. The second retaining portion 23 is bonded onto the surface of the third base portion 21 with a double-sided adhesive tape or the like. In this way, the second housing space 12 is formed between the obverse face of the second retaining portion 23 and the third base portion 21, which is on the second base portion 20, which is on the first base portion 10, in a substantially trapezoidal prism shape. The space is for accommodating accessories to the merchandise X, such as instruction manuals, replacement parts, etc.

The second retaining portion 23 is also provided with a second cut-out 23*a*. The second cut-out 23*a* is formed by cutting out a substantially elliptical portion of the second retaining portion 23. The second cut-out 23*a* retains a portion of the merchandise X and thereby restricts movement of the merchandise X. When the merchandise X is a dual-bearing reel, another end of the rod mounting leg part 93 of the reel (see FIG. 9) is inserted into the second cut-out 23*a* to restrict movement of the reel. The obverse face of the second retaining portion 23 of the seat part 2 carries a portion of the merchandise X. The second incision 23*b* is formed by cutting the second retaining portion 23 from an upward end to a fold line closest to the upward end. The second incision 23*b* creates a wide flap and a narrow flap. Referring to FIG. 5, the narrow flap contacts the third base portion 21 slightly inclined with respect to the third base portion 21. The wide flap, in which the second cut-out 23*a* is formed, is longer than the narrow flap. Accordingly, the wide flap contacts the third base portion 21 slightly inclined with respect to the third base portion 21 at a different inclination angle from that of the narrow flap.

Figure 3:
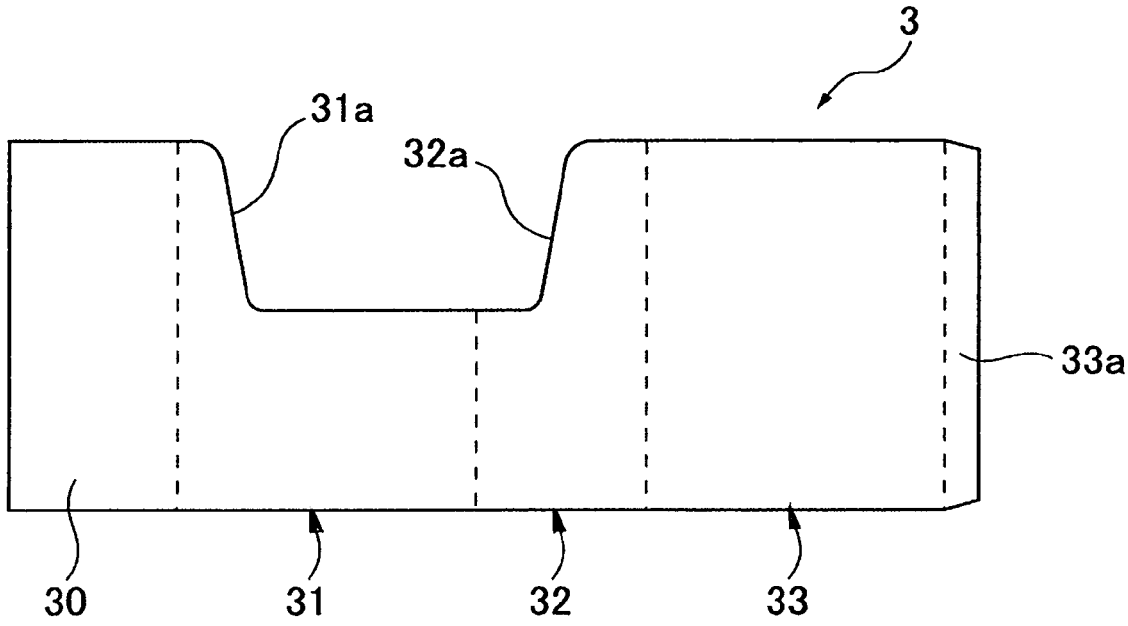
FIG. 3 is an elevational view of an obverse face of a cover part of the merchandise housing container in an unfolded condition in accordance with one embodiment of the present invention.
Figure 6:
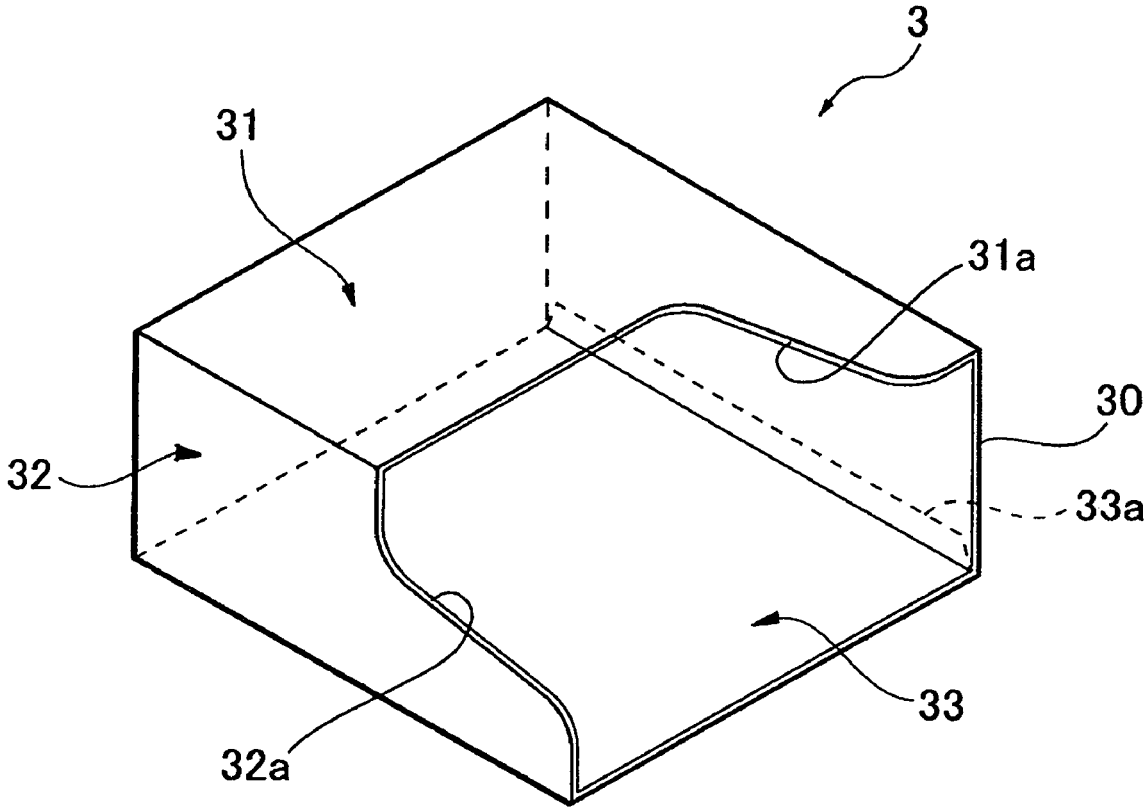
FIG. 6 is a perspective view of the cover part of the merchandise housing container illustrated in FIG. 3 in an assembled condition in accordance with one embodiment of the present invention.

Referring to FIGS. 3 and 6, the cover part 3 is fitted onto the outside of the inner box 1. When folded, the cover part 3 has a hollow box shape a portion of which is cut away. The cover part 3 is formed integrally by folding a single opaque sheet of paper, such as a corrugated cardboard. The name of the merchandise X, instructions, and the like are printed on at least one of the obverse faces.

Referring to FIG. 3, the cover part 3 has a ninth sidewall portion 30, a tenth sidewall portion 31, an eleventh sidewall portion 32, and a twelfth sidewall portion 33 that are formed consecutively in one direction so as to be folded one by one at right angles. A fourth joining tab 33*a* is bonded onto an end of the ninth sidewall portion 30 with a double-sided adhesive tape or the like. The fourth joining tab 33*a* is formed on an end of the twelfth sidewall portion 33 that is opposite the ninth sidewall portion 30. A first opening 31*a* and a second opening

32*a* are formed in the tenth sidewall portion 31 and the eleventh sidewall portion 32, respectively.

Referring to FIGS. 3, 6 and 8, the first opening 31*a* and the second opening 32*a* are formed by cutting away a portion near a connection between the tenth sidewall portion 31 and the eleventh sidewall portion 32. In such a location, the accommodated merchandise X is visible inside the inner box 1. The ninth sidewall portion 30, the tenth sidewall portion 31, the eleventh sidewall portion 32, and the twelfth sidewall portion 33 of the cover part 3 are fitted onto corresponding outer sides of the first sidewall portion 11, the lid portion 15, the third sidewall portion 13, and the first base portion 10, respectively. As illustrated in FIG. 8, the merchandise X, the first securing portion 16, the lid portion 15, the second sidewall portion 12, the third sidewall portion 13, the first retaining portion 22, the second retaining portion 23 and the sixth sidewall portion 25 are visible through the first opening 31*a* and the second opening 32*a* of the cover part 3.

The general procedure for assembling the merchandise housing container is explained in detail hereinbelow.

With the lid portion 15, the first securing portion 16 and the second securing portion 17 all in an open position, the seat part 2 is placed into the inner box 1 such that the second base portion 20 comes into contact with the first base portion 10. Next, the merchandise X is placed onto the first retaining portion 22 and the second retaining portion 23 of the seat part 2. The first securing portion 16 and the second securing portion 17 are then folded so as to elastically contact the sides of the merchandise X. Next, the lid portion 15 of the inner box 1 is closed. The cover part 3 is fitted over the inner box 1 so that the first opening 31*a* and the second opening 32*a* are arranged in such an orientation that the merchandise X is visible.

As used herein to describe the present invention, the following directional terms "forward, rearward, upward, downward, vertical, horizontal, below and transverse" as well as any other similar directional terms refer to those directions of a merchandise housing container equipped with the present invention. Accordingly, these terms, as utilized to describe the present invention should be interpreted relative to a merchandise housing container equipped with the present invention.

Although the foregoing embodiment has described a merchandise housing container having the inner box 1, the seat part 2 and the cover part 3, the invention is not limited to these configurations and a configuration may be employed in which the seat part 2 and the cover part 3 are eliminated. Furthermore, the merchandise X is not limited to dual-bearing reels and the present invention can be suitably applied to contain any merchandise, including fishing reels such as spinning reels and single-bearing reels.

The shapes of the inner box 1, the seat part 2 and the cover part 3 in unfolded configurations are not limited to those described in the foregoing embodiment, but various other shapes in unfolded configurations may be employed as long as the inner box 1, the seat part 2 and the cover part 3 are formed integrally. In addition, the shapes of the inner box 1 and the cover part 3 are not limited to a substantially rectangular parallelepiped shape as described in the foregoing embodiment, but other shapes such as a substantially polygonal prism shape or a substantially columnar shape may also be employed.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A merchandise housing container for accommodating a dual-bearing fishing reel having a leg and a handle comprising:

a base portion;

a plurality of sidewalls interconnected with and surrounding the base portion, and defining a first housing space for interiorly accommodating merchandise;

a primary lid portion interconnected with one of the sidewalls;

an auxiliary lid portion situated between the base portion and the primary lid portion, and interconnected with at least one of the sidewalls;

a securing device formed by folding an end section of the auxiliary lid portion inwardly multiple times to elastically contact a side of the fishing reel accommodated in the first housing space for restricting movement of the fishing reel, the securing device having at least one holding member coupled to a surface of the auxiliary lid portion, and the base portion, the sidewall and the securing device being formed integrally by folding a single sheet of transparent plastic; and a seat part having sidewalls substantially surrounding a base portion, the seat part being arranged within the first housing space and including a first retaining portion extending between opposing sidewalls of the seat part and a second retaining portion adjacent to the first retaining portion and including a plurality of surfaces extending approximately halfway between opposing sidewalls of the seat part, each of the retaining portions having a through-hole for receiving and securing a portion of the leg of the fishing reel, the base portion of the seat part having an obverse face on which the fishing reel is carried and positioned above the base portion of the container, formed therein between the obverse face of the base portion of the seat part and the second retaining portion is a second housing space arranged to accommodate an accessory to the fishing reel.

2. The merchandise housing container as set forth in claim 1, wherein the obverse face of the seat part has an incision for clasping the fishing reel formed by cutting a portion of the obverse face of the seat part.

3. The merchandise housing container as set forth in claim 2, wherein the seat part is formed integrally by folding a single sheet of paper.

4. The merchandise housing container as set forth in claim 1, wherein the seat part is formed integrally by folding a single sheet of paper.

5. The merchandise housing container as set forth in claim 4, wherein the primary lid portion is positioned to close over the first housing space.

6. The merchandise housing container as set forth in claim 4, further comprising a cover part fitted over the base portion of the container and having an opening through which the fishing reel is visible.

7. The merchandise housing container as set forth in claim 4, wherein the base portion of the container is substantially rectangular.

8. The merchandise housing container as set forth in claim 7, wherein the sidewalls of the base portion are folded from the base portion at a substantially right angle.

9. The merchandise housing container as set forth in claim 8, wherein the sidewalls of the base portion have four portions, each of which is substantially rectangular.

10. The merchandise housing container as set forth in claim 9, wherein the securing device includes two opposing portions of the four portions that are folded inwardly from the upward edge of the sidewalls of the base portion.

11. The merchandise housing container as set forth in claim 1, wherein the primary lid portion is positioned to close over the first housing space.

12. The merchandise housing container as set forth in claim 11, wherein the primary lid portion is formed unitarily with the base portion of the container, and the securing device by folding a single sheet of transparent plastic.

13. The merchandise housing container as set forth in claim 11, further comprising a cover part fitted over the base portion of the container and having an opening through which the fishing reel is visible.

14. The merchandise housing container as set forth in claim 1, further comprising a cover part fitted over the base portion of the container and having an opening through which the fishing reel is visible.

15. The merchandise housing container as set forth in claim 14, wherein the cover part is formed integrally by folding a single sheet of paper.

16. The merchandise housing container as set forth in claim 1, wherein the base portion of the container is substantially rectangular.

17. The merchandise housing container as set forth in claim 16, wherein the sidewalls of the base portion is folded from the base portion of the container at a substantially right angle.

18. The merchandise housing container as set forth in claim 17, wherein the sidewalls of the base portion have four portions, each of which is substantially rectangular.

19. The merchandise housing container as set forth in claim 18, wherein the securing device includes two opposing portions of the four portions that are folded inwardly from the upward edge of the sidewalls of the base portion.

20. The merchandise housing container as set forth in claim 1, wherein between one of the sidewalls of the seat part and the second housing space there is an opening on the obverse face to accommodate the handle of the fishing reel.

* * * * *